United States Patent [19]

Ruppert et al.

[11] 4,167,091

[45] Sep. 11, 1979

[54] CHUTE FILLING DEVICE FOR FILTER CIGARETTE CASINGS

[75] Inventors: Heinrich W. Ruppert; Klaus Gätschmann; Hans Haller, all of Trossingen, Fed. Rep. of Germany

[73] Assignee: Efka-Werke Fritz Kiehn GmbH, Trossingen, Fed. Rep. of Germany

[21] Appl. No.: 788,027

[22] Filed: Apr. 15, 1977

Related U.S. Application Data

[63] Continuation of Ser. No. 651,784, Jan. 23, 1976, abandoned.

[30] Foreign Application Priority Data

Oct. 14, 1975 [DE] Fed. Rep. of Germany ..... 2545891

[51] Int. Cl.[2] ..... B65B 35/30

[52] U.S. Cl. ..... 53/149; 53/151; 198/420; 221/296

[58] Field of Search ..... 198/420, 429, 446, 616, 198/454, 427; 221/296; 53/151, 149; 193/2 B; 214/301

[56] References Cited

U.S. PATENT DOCUMENTS

| | | | |
|---|---|---|---|
| 954,917 | 4/1910 | Bilgram | 53/151 |
| 1,615,626 | 1/1927 | Jagenberg | 53/151 |
| 1,688,982 | 10/1928 | Molins | 53/151 X |
| 1,769,650 | 7/1930 | Rose | 53/151 |
| 1,928,541 | 9/1933 | Ostrom | 53/151 |
| 1,986,215 | 1/1935 | Ostrom | 53/151 |
| 1,993,619 | 3/1935 | Neff et al. | 53/151 X |
| 2,239,589 | 4/1941 | Chalmers et al. | 53/151 |
| 2,759,309 | 8/1956 | Kemp | 53/151 |
| 2,765,894 | 10/1956 | Craig | 193/3 B |

*Primary Examiner*—Robert B. Reeves
*Assistant Examiner*—Douglas D. Watts
*Attorney, Agent, or Firm*—Browdy and Neimark

[57] ABSTRACT

A chute filling device for handling cigarette filter tubes has a funnel and a chute divided by partitions, as well as a discharge opening and a pushing arm, wherein the partitions are loosely suspended with play in slots in a swing frame, the partitions being capable of being set to oscillating in such manner that the cigarette filter tubes are braked as they fall by frequent contact with the chute walls and move downwardly while maintaining their horizontal attitude.

8 Claims, 2 Drawing Figures

CHUTE FILLING DEVICE FOR FILTER CIGARETTE CASINGS

This is a continuation, of application Ser. No. 651,784, filed Jan. 23, 1976 abandoned.

FIELD OF INVENTION

The present invention relates to package filling, and, more particularly, to a chute filling device for handling cigarette filter tubes, consisting of a funnel and a chute divided by partitions with a discharge opening and a pushing ram.

BACKGROUND

Packaging machines for packing round, rod-shaped objects, particularly cigarettes, are known in which the objects are fed into a chute through a funnel, the chute being sub-divided by partitions so that the material to be packed can be fed in individual units lying one on top of the other through a discharge opening. By means of a precise height-adjustable pushing ram batches always consisting of a constant number of units may be pushed out of the chutes, as a rule in the axial direction.

Further, a cigarette magazine is also known having at least one downwardly directed outlet sub-divided by partitions into chute compartments wherein the cigarettes are held ready in the outlet by virtue of their own dead weight, in individual rows lying tightly one on top of the other, for removal at the lower end. For packaging cigarettes in cigarette boxes or the like, a maximum height of fall of three cigarette diameters is required, whereby six chutes are provided for a package capacity of 18 cigarettes. The downward movement of the cigarettes under the influence of their own dead weight does not encounter any significant difficulties since the cigarettes have a symmetrically located center of gravity, and therefore possess stable falling properties and are additionally given a stable shape by the tobacco filler, i.e., they have a constant diameter and height.

While such packing of cigarettes from magazine subdivided by partitions into compartmented chutes is relatively simple, considerable difficulties arise when the known principle is to be used for packaging machines or filling devices for cigarette filter tubes without the tobacco filling. With a package content of 100 tubes, for example, seventeen chutes with six tubes each one above the other are required. Fillers must be inserted in two chutes. The fall height for a filing process is therefore six tube diameters. Because the paper tube is empty, the center of gravity of the cigarette filter tube is displaced toward the region of the filter, so that unless countermeasures are taken the tubes will fall with the filters pointed downward and will assume diagonal positions in the chutes. The instability of the empty paper tube means that no definite height can be established on the paper side of the packs, making it impossible to fix the height in the discharge opening, especially for retention of the seventh layer.

SUMMARY

Hence, an object of the present invention is to overcome the defects of the prior art, such as indicated above; another object is to provide for improved packing filling; another object is to make a chute filling device by means of which a precisely definable number of light weight cigarette filter tubes empty of tobacco can be pushed into a carton by means of a pushing ram, wherein damage to the tubes is avoided and pushing back of the next row of tubes for the following filling process can be reliably avoided during the expulsion of the first filling batch.

These objects are achieved according to the invention for a device of the general type described above primarily by having the partitions loosely suspended with play in slots in a swing frame, the partitions being capable of being set to oscillating in such manner that the cigarette filter tubes are braked as they fall by frequent contact with the chute walls and move downwardly while maintaining their horizontal attitude.

It is particularly advantageous according to an additional feature of the invention if electromagnetic vibrators are provided for the funnel. Further, an eccentric arrangement driven by an adjustable motor can be used advantageously as the vibration generator for the swing frames. According to a further feature of the invention the partitions are mounted on slots on the floorplate, and the pushing ram is advantageously slotted in a comblike fashion and is provided with a fixed height.

According to an improvement of the invention, it is advantageous, in order to hold back the lowest layer intended for the second filling process, to have a suction strip provided with suction nozzles in the chute wall which faces the filters. In a preferred embodiment of the invention, one such nozzle is mounted in the same horizontal plane as each cigarette filter tube.

The retention of the seventh layer in each case is advantageously accomplished by providing elastic retention or restraining means at the uppermost limit of the discharge opening for the next layer of tubes of the next group of tubes to be expelled. This restraining means, according to one embodiment of the invention, can be made in the form of a brush.

The invention provides for reliable determination of the number of units in a batch, a more careful treatment of the tubes by eliminating the previously employed separating ram and retention of defective tubes, since e.g., tubes with open seams, tubes crushed by manual loading into the containers, or tubes that stick together cannot pass through the chute system. Further advantages and features of the invention will be seen in greater detail from the drawings, which show an embodiment in schematic form.

DETAILED DESCRIPTION OF EMBODIMENT

Figure 1:
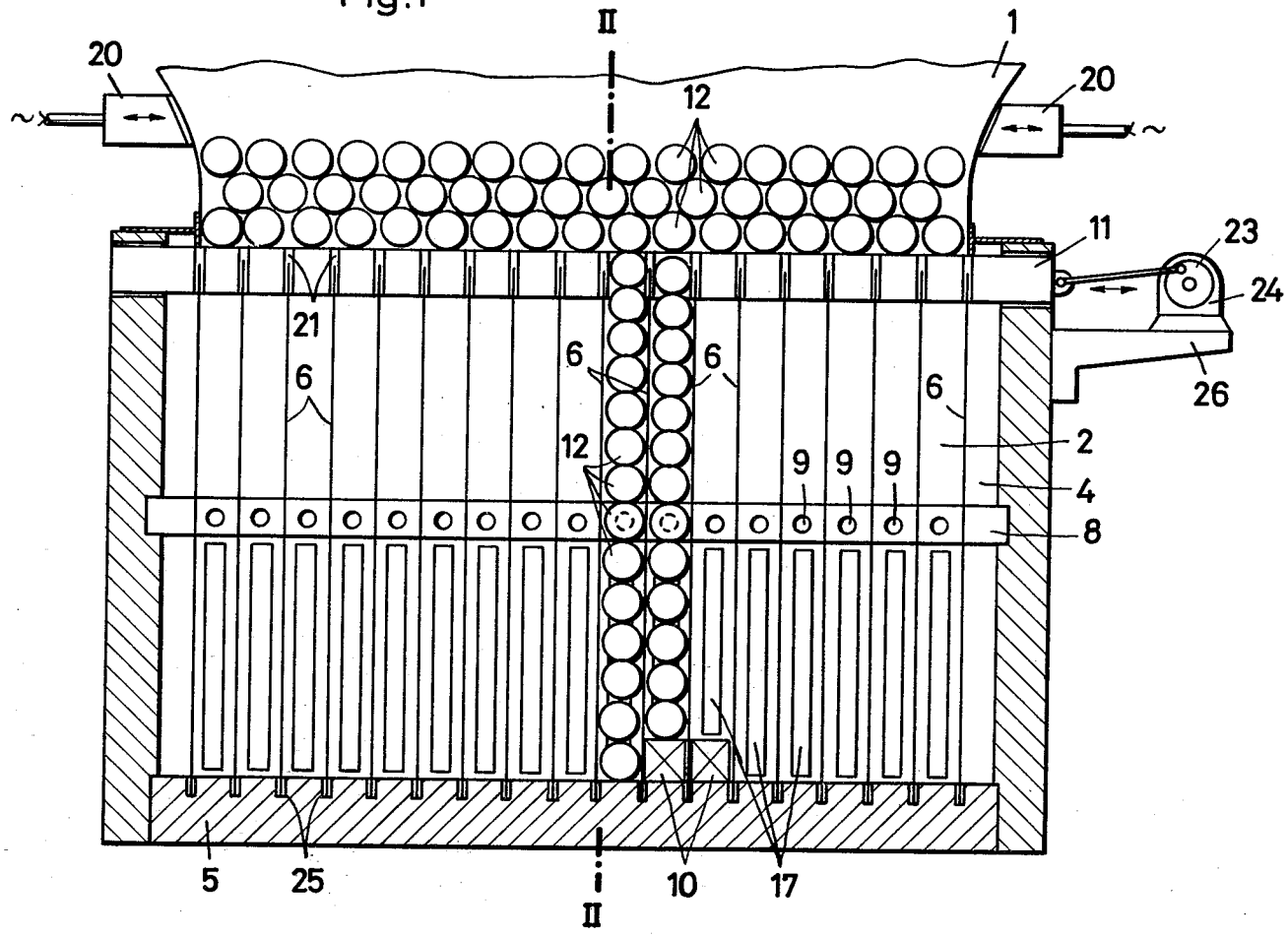
FIG. 1 is a cross section through a chute filling device according to the invention.

It can be seen from the drawing that the chute filling device according to the invention is provided with a known funnel 1 to which finished empty cigarette filter tubes 12, arranged according to paper side 13 and filter side 14, are fed. The funnel 1 can be set vibrating by electromagnetic vibrators 20 at very high frequency but small amplitude, in order to prevent jamming of the cigarette filter tubes with which it is filled.

A chute 2 is located beneath the funnel 1, such chute being provided with a front panel 3 and a back wall 4 as well as a side wall, not shown. The chute filling device has a floorplate 5 mounted on a supporting device (not shown), for example a work table or the like.

A plurality of chute partitions 6, preferably made of spring bronze, are mounted with play in slots 21 on a swing frame 11 mounted below the outlet end of the funnel 1 with the lower ends of the chute partitions 6 resting in slits 25 in the floorplate 5. The swing frame 11 is provided with an eccentric arrangement 23 driven by an adjustable motor 24 in such manner that the frame 11 is set oscillating by the eccentric arrangement 23. Such eccentric arrangement 23 with the motor 24 is mounted on a bracket 26 on one wall of the chute 2.

In the embodiment shown, intended for packing a hundred casings 12, eighteen chute partitions 6 are mounted in a row so that seventeen compartments are created. In order to ensure that a hundred tubes are provided with each discharge process, blanks 10 are provided in two compartments. FIG. 1 shows only two rows of tubes, but in fact each compartment is filled with the tubes 12.

Figure 2:
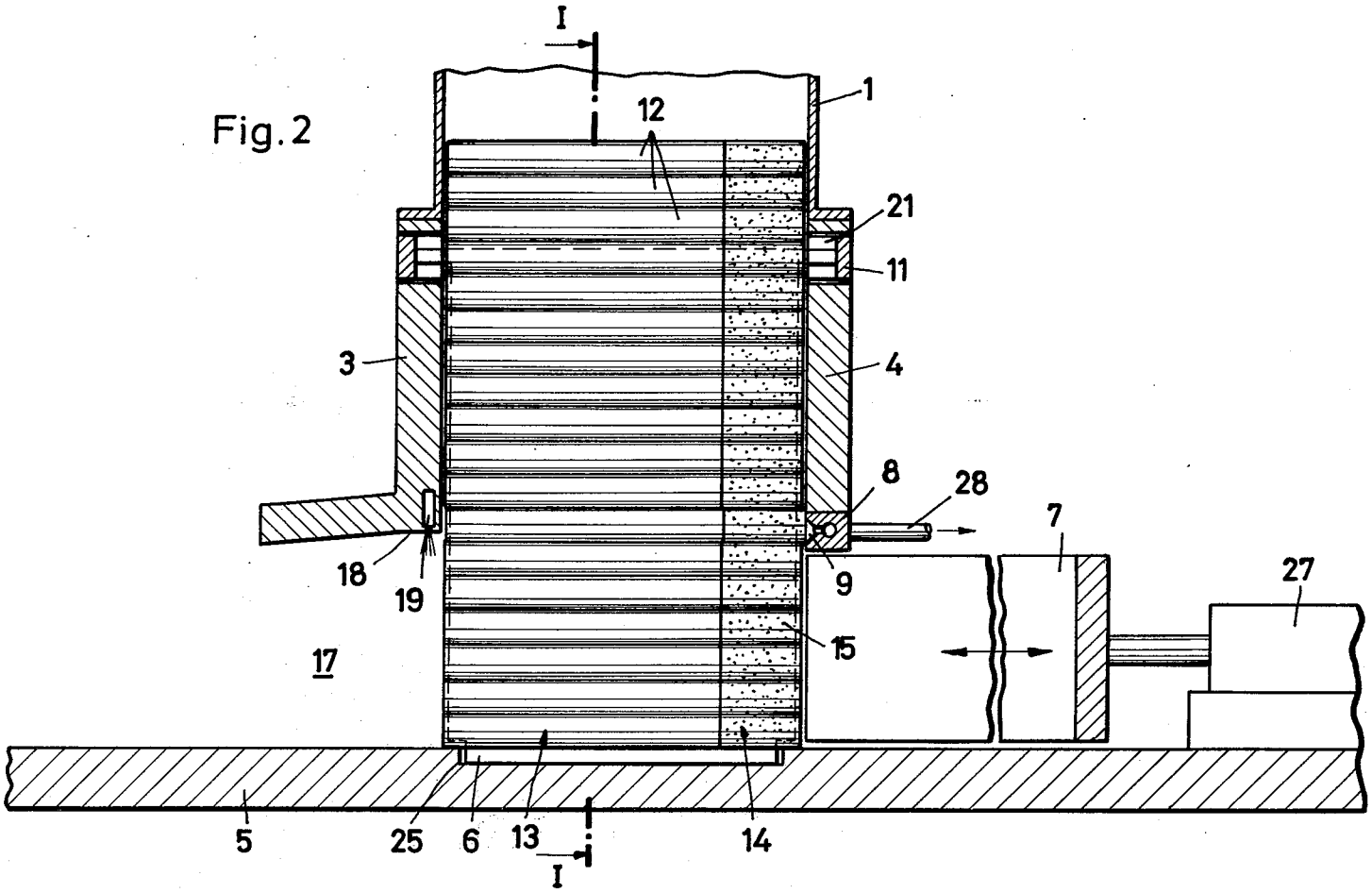
FIG. 2 is a cross section through a device according to FIG. 1 along line II—II in FIG. 1.

At the back of the chute 2, as shown in FIG. 2, there is provided a pushing ram 7 in the form of a comb; the ram 7 is displaceable in the axial direction of the tubes 12, the ram serving to push six to five shells parallel to the floorplate 5 into a discharge opening 17 and into a carton (not shown) in each filling process from a compartment formed by the chute walls 6. A cylinder-piston unit 27, pneumatically or hydraulically operated, serves to drive this ram 7.

At a height of six filter pack diameters above the floorplate 5, there is mounted a suction strip 8 with suction nozzles 9. The suction strip 8 and suction nozzles 9 are connected by a preferably flexible line 27 with a vacuum device, e.g., an air pump. The suction strip 8 serves to hold back the seventh layer of packs during the discharge process. This retention is reinforced by a mouthpiece-like restraining device 19 at the upper edge 18 of the discharge opening 17. In the embodiment shown, the elastic restraining means consists of brushes with soft bristles. However, an air curtain or other suitable retention means can be provided instead.

The chute filling device according to the invention operates as follows: the tubes 12 are fed into the chute 2 via the funnel 1, set vibrating by vibrators 20, the chute being divided into 17 individual chutes by the partitions 6 loosely suspended with play in the slots 21. The swing frame 11 is set mechanically vibrating by means of the eccentric arrangement 23 and the adjustable motor 24. The partitions 6 vibrate as a result of the corresponding movement of swing frame 11 in such manner that, as a result of the frequency and amplitude, the cigarette filter tubes 12 empty of tobacco are braked as they fall in the individual chutes by frequent contact with the chute partitions 6, particularly on the filter side 14, thereby ensuring that the tubes 12 fall downwardly in an essentially horizontal position.

After this filling process is completed, the tubes 12 on the filter side 14 are expelled in their lengthwise direction by means of the precisely height-adjustable ram 17 provided with comb-like slits. At the same time, the seventh layer of packs is attached and held firmly by the action of the suction nozzles 9 provided in the suction strip 8 on the filter side 14 of the shells 12. Moreover, The adjustable retention device 19 which carries on its lower end at least one elastic restraining member, shown as a brush, provided on the upper edge 18 of the discharge opening 17, ensures considerable adaptability to the individual heights of the blocks of tubes on paper side 13, thus reinforcing retention of the seventh row.

The invention is not limited to the embodiment shown and described, but also includes all modification and improvements made by routineers and experts in the field, particularly with regard to the number of cigarette tubes to be expelled in each loading process, the arrangement and design of suction nozzles 9 and suction strip 8, and the arrangement and shape of the elastic restraining means on front plate 3. The invention also includes all partial and sub-combinations of the features and measures described and/or shown.

It will be obvious to those skilled in the art that various changes may be made without departing from the scope of the invention and the invention is not to be considered limited to what is shown in the drawings and described in the specification.

What is claimed is:

1. In a chute filling device for use solely with cigarette tubes empty of tobacco and having respective filters on one end thereof, the device including a funnel and a chute divided by partitions with a discharge opening and a pushing ram, the improvement comprising:

means for loosely suspending said partitions with substantially uniform play throughout their lengths, said means for suspending including a first plurality of slits of substantially uniform width along their lengths and depths in a plate defining a floor of the device and a second plurality of slits of substantially uniform width along their lengths and depths in a swing frame, one end of each of said partitions being placed in a respective one of said slits of uniform width in said plate and the other end of each of said partitions being placed in a respective one of said slits of uniform width in said swing frame, said uniform width of each of said slits being greater than the thickness of the respective end of that partition positioned therein, and means to vibrate said partitions to impart lateral movements of adjacent ones of said partitions toward and away from one another so that the cigarette tubes empty of tobacco and having the respective filters at ends thereof are braked in their downward fall after each action of the pushing ram by frequent contact with slides of said partitions which vibrate with lateral motion towards and away from adjacent ones thereof in said slits of substantially uniform widths, the tubes moving downwardly while maintaining a substantially horizontal position as a result of the braking action.

2. An improved filling device according to claim 1, further comprising an electromagnetic vibrator for said funnel.

3. An improved filling device according to claim 1, wherein said means to vibrate said partitions comprises an eccentric arrangement coupled to said swing frame as a vibration generator for said swing frame.

4. An improved filling device according to claim 1, wherein said pushing ram is formed with comblike slits and is provided with a fixed height.

5. An improved filling device according to claim 1, further comprising suction means to retain a layer of tubes, said suction means being provided in the chute at the height of said discharge opening and facing the filters of the tubes.

6. An improved filling device according to claim 5, wherein said suction means comprises a plurality of suction nozzles being arranged in the same horizontal plane adjacent one another and each facing a cigarette filter tube.

7. An improved filling device according to claim 1, further comprising an elastic restraining means provided at the upper limit of said discharge opening for the next row of tubes, following the number of tubes being expelled.

8. An improved filling device according to claim 7, wherein said restraining means comprises a brush.

* * * * *